United States Patent [19]
Satoh

[11] 4,030,101
[45] June 14, 1977

[54] REGULAR EIGHT-FACE POLYHEDRAL ANTENNA ELEMENT

[76] Inventor: Kazuhisa Satoh, 24-10-1 Megurohoncho, Meguro, Tokyo, Japan

[22] Filed: Mar. 15, 1976

[21] Appl. No.: 667,154

Related U.S. Application Data

[63] Continuation-in-part of Ser. No. 503,699, Sept. 6, 1974, abandoned.

[52] U.S. Cl. ..... 343/872; 343/896
[51] Int. Cl.² ..... H01Q 1/36; H01Q 1/42
[58] Field of Search ..... 343/742, 803, 804, 896, 343/908

[56] References Cited

UNITED STATES PATENTS

| | | | |
|---|---|---|---|
| 2,472,106 | 6/1949 | Hansen | 343/804 |
| 3,005,982 | 10/1961 | Bernfeld | 343/742 |

*Primary Examiner*—Eli Lieberman
*Attorney, Agent, or Firm*—McGlew and Tuttle

[57] ABSTRACT

The antenna element, which is for use in television reception and the like, is manufactured from a single length of metallic bar or tubing which is bent to form the longitudinal edges of a regular eight face polyhedron, with the two ends of the length of metallic bar or tubing being bent outwardly parallel to each other at the bottom of the antenna element to constitute terminals. The antenna element has directional characteristics in four directions, in contrast to conventional antennas, such as dipole antennas or loop antennas, which have directional properties in only two directions, and can be miniaturized by utilizing known printed circuit manufacturing techniques. The antenna element has its best capacity when the length of each edge of the polyhedron is equal to one half the wavelength of an electromagnetic wave of a predetermined frequency. In order to avoid the antenna element having too great a length, and thus being disadvantageous from the standpoint of wind pressure or mounting, several antenna elements may be connected in series with each antenna element having the longitudinal edge of the polyhedron being equal to one half the selected wavelength divided by the number of antenna elements connected in series.

7 Claims, 23 Drawing Figures

FIG. 8A1
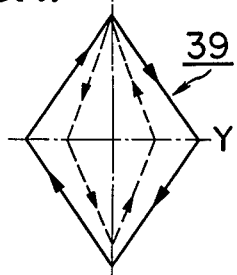
FIG. 8A'1
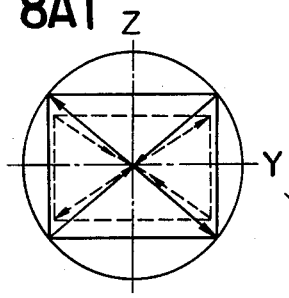
FIG. 8A"
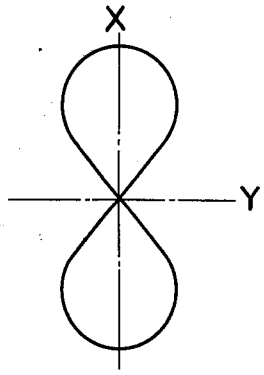
FIG. 8A2
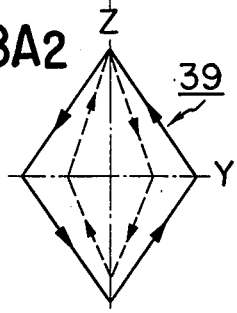
FIG. 8A'2
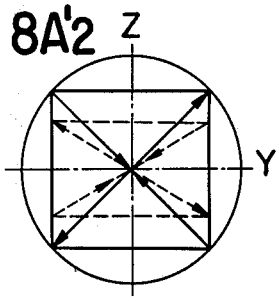
FIG. 8B1
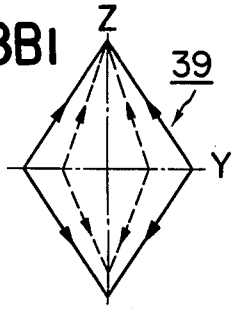
FIG. 8B'1
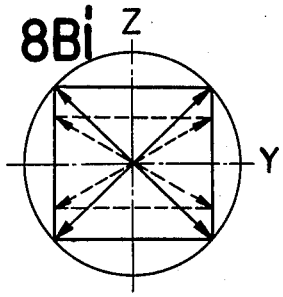
FIG. 8B"
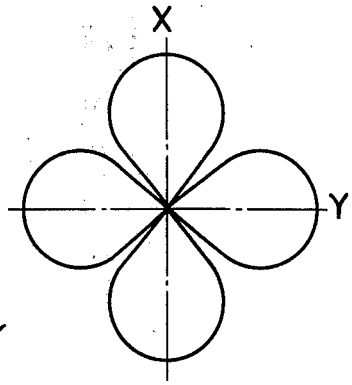
FIG. 8B2
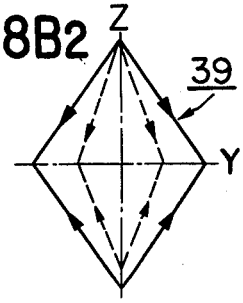
FIG. 8B'2
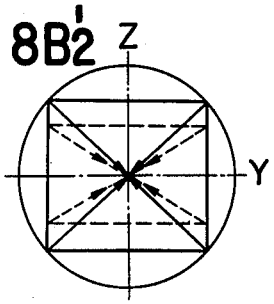
FIG. 9A
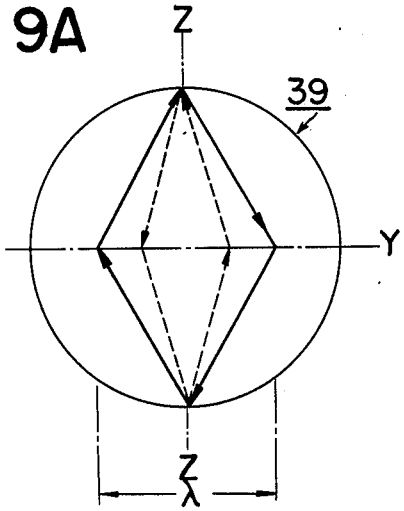
FIG. 9B
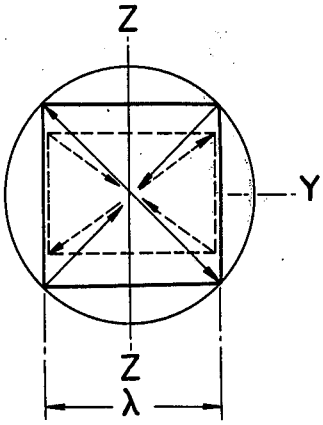

REGULAR EIGHT FACE POLYHEDRAL ANTENNA ELEMENT

CROSS-REFERENCE TO RELATED APPLICATION

This application is a continuation-in-part of copending application Ser. No. 503,699, filed Sept. 6, 1974, now abandoned.

FIELD AND BACKGROUND OF THE INVENTION

This invention relates to antennas for use in television reception and the like and, more particularly, to a novel and improved antenna having directional properties in four directions and capable of miniaturization by the use of printed circuit manufacturing techniques.

In a general classification of antennas for television reception and the like, there are two kinds of antennas, namely a dipole antenna and a loop antenna, both of which are conventional. However, these conventional antennas have directional properties in only two directions, so that the electromotive forces induced therein are relatively small thereby the range of frequencies which may be received by the conventional antennas is rather limited. For these reasons, such conventional antennas require a large space and must be sufficiently large in size in an attempt to meet the requirements of nondirectional properties, or large induced electromotive forces, or adaptability to a wide range of frequencies, or all three of these requirements.

SUMMARY OF THE INVENTION

This invention relates to a regular eight face polyhedral antenna element and to methods of making the same, and has the objective of providing a new and improved antenna element.

In accordance with one embodiment of the invention, a regular eight face polyhedral antenna element is formed from a single length of metallic bar or tubing bent to form the longitudinal edge lines of an eight face polyhedron, with the two ends of the length of metallic bar or tubing being bent outwardly and substantially parallel each other at the base of the antenna to constitute terminals.

In another embodiment of the invention, the antenna element is formed by printing a plane development of the antenna element in oxidation resistant ink on a silver plated substrate, with the unprinted portions of the silver plated layer being removed with an aqueous acidic solution to leave only the developed figure of a regular eight face polyhedralantenna element on the substrate.

The primary object of the invention is to provide an antenna element which may be miniaturized into an extremely small antenna element as compared with conventional antennas, such as dipole antennas or loop antennas, and which has an induced electromotive force much greater than that of the conventional antennas and furthermore has directional properties in four directions as compared to the directional properties in two directions of the conventional antennas.

Another object of the invention is to provide such an antenna element which can be adapted to any frequency by selecting a number of the antenna elements and connecting them in series with each other.

A further object of the invention is to provide an antenna which can be constructed to stand on a small space and which is formed by connecting a number of antenna elements embodying the invention in series with each other, setting the assembled elements in a frame, and superposing a number of frames one on the other with all of the antenna elements being connected in series with each other.

Yet another object of the invention is to provide an antenna which can withstand wind pressure, is substantially resistant to damage by salt air, is built solidly, and is capable of long use, by setting an antenna element or elements in a casing formed of dielectrical material.

A further object of the invention is to provide such an antenna in the form of a printed circuit whereby the antenna may be mass produced.

For an understanding of the principles of the invention, reference is made to the following description of typical embodiments thereof as illustrated in the accompanying drawings.

BRIEF DESCRIPTION OF THE DRAWINGS

In the drawings:

FIGS. 8A1 – 8B2 are vector diagrams corresponding to the specific example shown in FIG. 6, and showing the forces and their directions, as well as the magnitudes, with the electric charges on the antenna element received from the electric field;

FIGS. 8A'1–8B'2 are vector diagrams corresponding to the specific example shown in FIG. 7 and showing the forces and their directions, as well as the magnitudes, with the respective electric charges corresponding to each of FIGS. 8A1–8B2 received from the electric field in a condition extending over a period of time;

FIGS. 8A'' and 8B'' show the horizontal directional properties of a conventional antenna element and an antenna element embodying this invention, respectively;

FIG. 9A' is a vector diagram corresponding to the example shown in FIG. 6 and showing the force and direction as well as the magnitude which the electric charge on an antenna element embodying the invention receives from the electric field or the length of a section of the antenna element, or the length between two consecutive bends, is taken as $\lambda/n$, corresponding to the length of an edge of an edge of a regular eight face polyhedron, and where an antenna comprising $n$ antenna elements connected in series with one another is represented by the case of $n = 2$;

FIG. 9B' is a vector diagram, similar to FIG. 9B, but related to FIG. 9A';

DETAIL DESCRIPTION OF THE PREFERRED EMBODIMENTS

Figure 1:
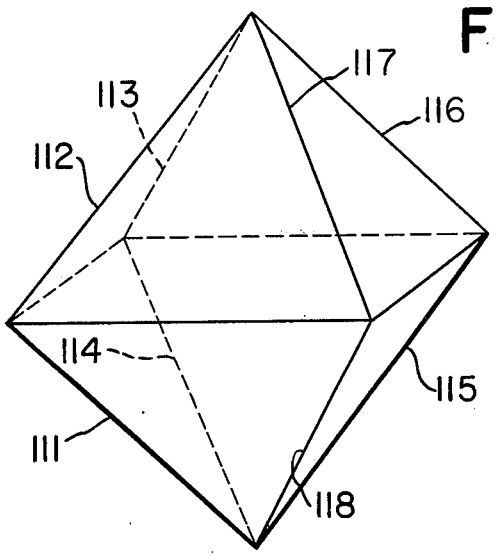
FIG. 1 is a perspective view of a regular eight face polyhedron upon which the antenna element of the invention is based.
Figure 2:
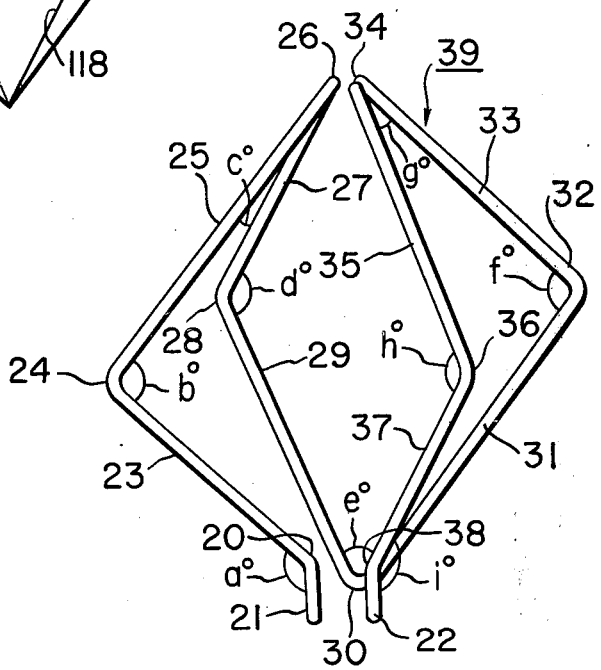
FIG. 2 is a perspective view of a regular eight face polyhedron antenna element embodying the invention.

The invention will be described initially with reference to FIGS. 1 and 2, of which FIG. 1 is a perspective view of a regular eight face polyhedron having longitudinal edges indicated at 111, 112, 113, 114, 115, 116, 117 and 118. FIG. 2 is a perspective view of an antenna element embodying the invention, and which is manufactured from a single continuous length of metallic bar or tubing bent to form the longitudinal edge lines of a regular eight face polyhedron such as shown in FIG. 1, and with the oposite ends of the length of metallic bar or tubing being located at the bottom of the antenna element to constitute terminals thereof.

The antenna element shown in FIG. 2 is formed in a manner which will now be described. A single length of metallic bar or tubing has terminal ends 21 and 22 which, in the formed antenna element, constitute the two terminals thereof. Starting from the end 21, the single length of metallic bar or tubing is bent outwardly at an angle $a°$ of 135° at a first bend 20 to provide a first section 23 corresponding to a first longitudinal edge 111 of the regular eight face polyhedron shown in FIG. 1. The element is then bent, at a bend 24, upwardly and inwardly at an angle $b°$ equal to 90° to provide a second section 25 corresponding to a second longitudinal edge 112 of the polyhedron shown in FIG. 1. Following this, the single length of metallic bar or tubing is then bent, at a bend 26, downwardly and outwardly at an angle $c°$ of 60° to form a third section 27 corresponding to a third longitudinal edge 113 of the polyhedron of FIG. 1, after which the length of metallic bar or tubing is bent at a bend 28 downwardly and inwardly at an angle $d°$ of 90° to provide a fourth section 29 corresponding to a fourth longitudinal edge 114 of the polyhedron of FIG. 1.

At the end of the fourth section 29, the length of metallic bar or tubing is bent, at a bend 30, upwardly and outwardly at an angle $e°$ of 60° to form a fifth section 31 corresponding to a fifth longitudinal edge 115 of the polyhedron of FIG. 1,, and is then bent, at a bend 32, upwardly and inwardly at an angle $f°$ of 90° to provide a sixth section 33 corresponding to a sixth longitudinal edge 116 of the polyhedron of FIG. 1. The single continuous length of metallic bar or tubing is then again bent, at a bend 34, outwardly and downwardly through an angle $g°$ equal to 60° to form a seventh section 35 corresponding to the seventh longitudinal edge 117 of the polyhedron of FIG. 1, and is then bent, at a bend 36, downwardly and inwardly at an angle $h°$ of 90° to provide an eighth section 37 corresponding to an eighth edge 118 of the polyhedron of FIG. 1. Finally, the single length is then bent downwardly at a bend 38 through an angle $i°$ of 135° to provide the terminal 22.

In the above procedure, each of the successive sections 23, 25, 27, 29, 31, 33, 35 and 37 has substanially the same length and together they constitute a frame shape antenna element in the form of a regular eight face polyhedron having longitudinal edges each corresponding to a respective section 23, 25, 27, 29, 31, 33, 35 and 37.

There are instances wherein the antenna element 39, shown in FIG. 2, is used as the only antenna element constituting an antenna. However, in the usual case, a plurality of antenna elements 39 are used to form an antenna, with the number of elements used depending upon the desired frequency response. The elements 39, as shown in FIG. 3, are mounted on a base 40 of dielectric or other non-electrically conductive material, and the several elements 39 are connected in series with each other by leads or conductors 41, the base plate 40 being mounted on legs 42.

Figure 3:
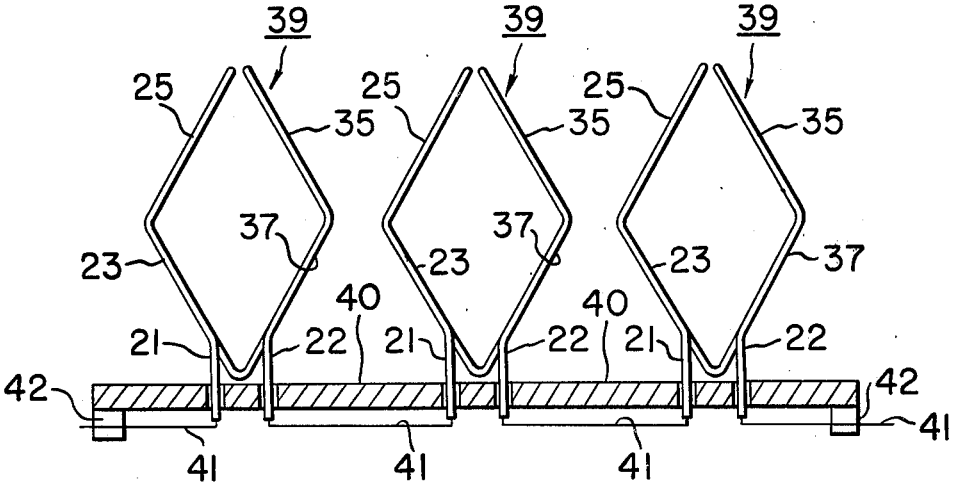
FIG. 3 is a front elevation view of an antenna comprising a number of antenna elements, such as shown in FIG. 2, connected in series with each other and mounted on a support plate formed of dielectric material or being otherwise non-electrically conductive.
Figure 4:
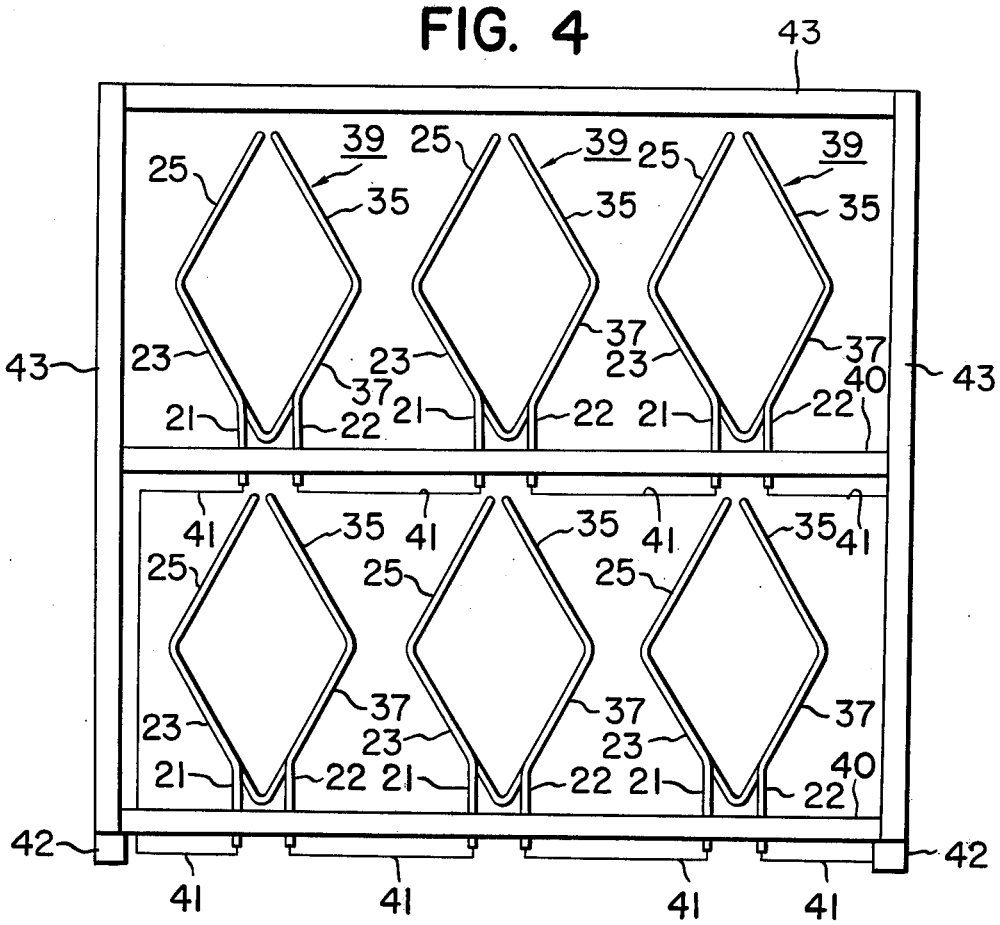
FIG. 4 is a front elevation view of an antenna embodying the invention and formed by a number of antennas, such as shown in FIG. 3, superposed on each other and with all of the antenna elements being connected in series.

In a further embodiment shown in FIG. 4, several of the antennas such as shown in FIG. 3 are supported in superposed relations in a frame generally indicated at 43, and again all of the antenna elements 39 are connected in series with each other through the leads 41, which are brought out to suitable terminals.

Figure 5:
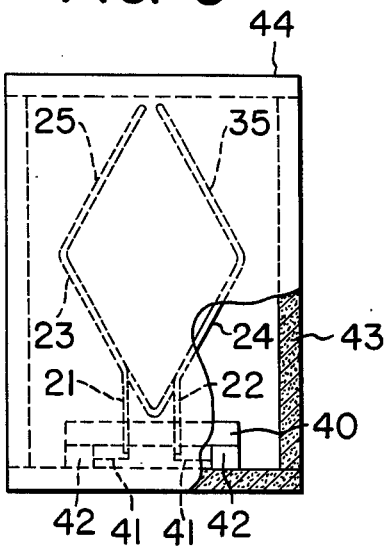
FIG. 5 is a front elevation view, partly in section, of an antenna element embodying the invention mounted in sealed relation in a casing of dielectric or otherwise non-electrically conductive material.

In another embodiment of the invention, such as shown in FIG. 5, either the antenna element 39 of FIG. 2, the antenna of FIG. 3, or the antenna of FIG. 4 is mounted in sealed relation in a casing 44 made of dielectric or non-electrically conductive material, such as glass, plastics, or wood, as indicated at 43.

For describing the working and the advantages of the invention, the easiest way is to illustrate a front view of a regular eight face polyhedron, but it is neither possible to illustrate correctly the polyhedron nor possible to show correctly the symmetrical correlation between the respective longitudinal edges thereof simply in a front view. Therefore, let it be assumed that, as shown in FIG. 6, a regular eight face polyhedron is represented by four longitudinal edge lines 111, 112, 117 and 118 on the front side of the polyhedron, and illustrated in full lines, and by four longitudinal edge lines 113, 114, 115 and 116 on the rear side, and which are shown as broken lines, and let it be further assumed that each of the edge lines 111–118 shown in FIG. 6 represents a respective section 23, 25, 27, 29, 31, 33, 35 and 37 of an antenna element embodying the invention, such as shown in FIG. 2.

Figure 6:
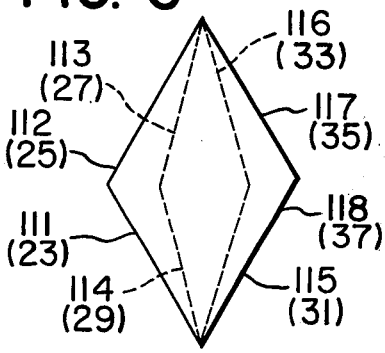
FIG. 6 is a front view of a specific example of a regular eight face polyhedron similar to that shown in FIG. 1.
Figure 7:
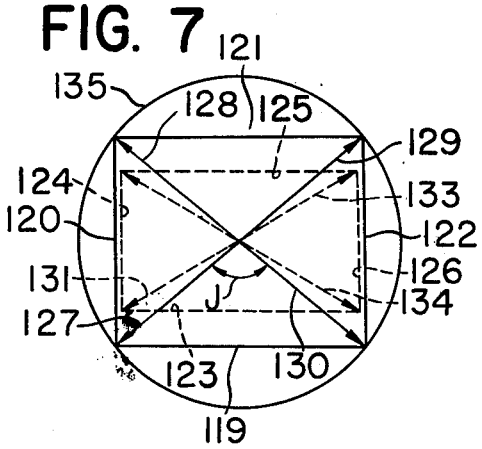
FIG. 7 is a vector diagram of a specific example of an antenna element embodying the invention and illustrating the eight vectors directed to the respective eight corners from the center of a regular six-face polyhedron forming the symmetry planes in respect to a regular eight face polyhedron.

FIG. 7 shows a regular six face polyhedron constituting the symmetry planes of a regular eight face polyhedron as shown in FIG. 6, and also shows arrows designating the eight vectors directed from the center of the six face polyhedron to the respective corners of the regular six face polyhedron. The solid lines 119, 120, 121, and 122 designate the longitudinal edge lines of the front face of the regular six face polyhedron, and the broken lines 123, 124, 125 and 126 designate the longitudinal edge lines of the rear face of the six face polyhedron. The four vectors directed from the center of the regular six face polyhedron to the corners of the front side are indicated at 127, 128, 129 and 130 in solid lines, and the four vectors directed from the center of the regular six phase polyhedron to the corners of the back face thereof are designated 131, 132, 133 and 134 and are shown in broken lines. Reference numeral 135 indicates a sphere which circumscribes the regular six face polyhedron, and respective adjacent vectors have an included angle of 54°44′.

If it is assumed that the length of a side of the figure presenting a regular eight face polyhedron as shown in FIG. 6 is λ, and if it is assumed that a sphere circumscribing the eight face polyhedron of FIG. 6 is identical with the sphere shown at 135, it is apparent that the sphere circumscribing the eight face polyhedron should have a diameter of $\sqrt{2\lambda}$.

Referring to FIG. 8, in indicating, with arrows, on a regular eight face polyhedron, such as shown in FIG. 6, the forces and their directions which the electric charge $q$ on an antenna element 39 is receiving, these may be shown as indicated in FIGS. 8A1, 8A2, 8B1 and 8B2.

An antenna element embodying the invention will be excited by an electromagnetic wave of a certain frequency, such as when, for example, the regular eight face polyhedron has a longitudinal side whose length is equal to one quarter of the wave length, whereby the electric charges $q$ will receive the forces as shown with arrows in FIG. 8A1 and 8A2. It will also be excited by an electromagnetic wave having twice this wave length, such as when the respective sections 23, 25, 27, 29, 31, 33, 35 and 37, constituting the antenna element 39 embodying the invention, have respective lengths equal to one half of the wave length. In this case, the electric charge $q$ will receive the forces having the directions as shown with the arrows in FIG. 8B1 and 8B2.

When assuming that the electric field advances spatially an equal distance in all directions during a time period, and when it is assumed that, in such a case, the electromagnetic wave is referred back to a starting, the forces and their directions, as well as the magnitudes thereof, which the electric charge $q$ on the antenna element receives from the electric field may be represented by FIGS. 8A′1, with respect to FIG. 8A1, by FIG. 8A′2, with respect to FIG. 8A2, by FIG. 8B′1, with respect to FIG. 8B1, and by FIG. 8B′2, with respect to FIG. 8B2.

FIGS. 8A′1, 8A′2, 8B′1 and 8B′2 are correlated with the illustration in FIG. 7. Since there are two symmetrical axes with respect to the Z axes in FIGS. 8A1 and 8A2, and four symmetrical axes with respect to the Z axis in FIGS. 8B1 and 8B2, as shown in the respective associated FIGS. 8A′1, 8A′2, 8B′1 and 8B′2, in the case where it is assumed that the conditions were traced back to the starting time, the horizontal directivity will exhibit two-directional directivity, as shown in FIGS. 8A″, in the case of FIG. 8A1 and FIG. 8A2, and four-directional directivity, as shown in FIG. 8B′, in the case of FIG. 8B1 and 8B2. In contrast to the known dipole antenna or loop antenna, which exhibits a pattern of only two-directional directivity, as shown in FIG. 8A″, the antenna element 39 embodying the invention has not only the two-directional directivity as shown in FIGS. 8A″ but also has the four-directional directivity as shown in FIG. 8A″.

In an antenna element 39 embodying the invention, the forces received by the electric charge on the respective sections 23, 25, 27, 29, 31, 33, 35 and 37, forming the antenna element 39, can be considered as the forces received by the electric charge on a dipole antenna on the Y axis, as shown in FIGS. 8A1, 8A2, 8B1 and 8B2. Then, assuming that the antenna is a receiving antenna, with the electric field at the center thereof being $E_m$, and that the length of each of the several sections constituting the antenna element 39, and which are the sections corresponding to the longitudinal edges of a regular eight face polyhedron, is taken as $l$, the expected induced electromotive force has the formula:

$$eO = 4\, l\, E_m \operatorname{Cos} \omega\, t \qquad \text{I}$$

On the other hand, the induced electromotive force of a bar antenna having a length $l$ is:

$$ed = l\, E_m \operatorname{Cos} \omega\, t \qquad \text{II}$$

and the induced electromotive force eR of a circular antenna having a diameter is $$eR = 2l\, E_m \operatorname{Cos} \omega\, t \qquad \text{III}$$

It is therefore evident that, when comparing equations I, II and III, an antenna element embodying the invention has a greater inducted electromotive force which is as much as four times as great as that of a bar antenna and twice as great as that of a circular antenna.

Figure 9A:
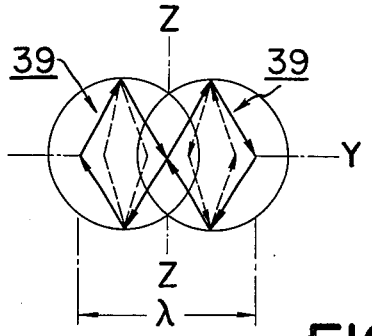
FIG. 9A is a vector diagram of the specific example shown in FIG. 6 and showing the force and direction, as well as the magnitude, which the electric charge on an antenna element in accordance with the invention receives from the electric field, where the length of a section of the antenna element, or the length between two consecutive bends, is λ, corresponding to a longitudinal edge of a regular eight face polyhedron.

As set forth above, there has been described how a single antenna element 39, embodying the invention, has not only four-directional directivity, a specific directivity near to non-directivity as compared with known dipole and loop antennas, but also has a greater electromotive force in comparison with that of the known antennas. As explanation will now be given with respect to an antenna including a plurality of antenna elements 39, embodying the invention, and which are connected in series with each other and mounted on an insulated base plate 40, as shown in FIG. 3. Referring to FIG. 9A, let it be assumed that each of the sections 23, 25, 27, 29, 31, 33, 35 and 37 constituting an antenna element 39 embodying the invention has a lengthl 80 . It will be explained that this antenna has a value equivalent to λ $n$ antenna elements 39, each having eight sides and each side having a length of 80 /$n$, the elements 39 being connected in series with one another as shown in FIG. 9A′.

Figure 9B:
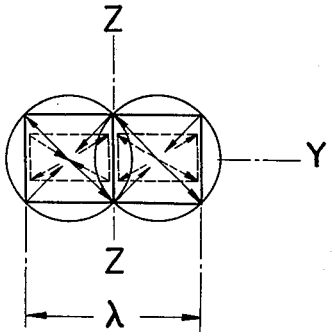
FIG. 9B is a vector diagram, corresponding to the specific example shown in FIG. 7, illustrating the forces and their directions, as well as the magnitudes, which the electric charges shown in FIG. 9A possess over a period of time.

In the same manner as in the case of FIGS. 8A′1, 8A′2, 8B′1 and 8B′2, the forces which the electric charge $g$ has on the pertinent antenna, when traced back to the starting time, are shown as vectors in FIGS. 9B and 9B′ which illustrations correspond to that of FIG. 7.

It is well known that an electromagnetic wave in free space can be described by Maxwell's Equation. This equation does not vary with respect to the Lorenz transformation. The Lorenz transformation is represented by the following formula IV:

$$X' = \frac{X - ut}{\sqrt{1 - u^2/c^2}}$$
$$Y' = Y$$
$$Z' = Z$$
$$t' = \frac{t - uX/c^2}{\sqrt{1 - u^2/c^2}} \qquad \text{IV}$$

In this formula, $X$, $Y$, $Z$ and $t$ represent the variables on certain coordinate axes, and $X'$, $Y'$, $Z'$ and $t'$ represent the variables on the coordinate axes that are moving at a rate $u$ relative to the coordinate axes X, Y, Z and $t$. Formula IV can then be written as follows:

$$X'^2 + Y'^2 + Z'^2 - c^2t'^2 = X^2 + Y^2 + Z^2 - C^2t^2 \qquad \text{V}$$

If the interval between the origin of the coordinate axes X, Y, Z, $t$ and the origin of the coordinate axes X', Y', Z', $t'$ is taken as O, Formula V can be represented as follows:

$$X'^2 + Y'^2 + Z'^2 = c^2t'^2$$

$$X^2 + Y^2 + Z^2 = c^2t^2 \qquad \text{VI}$$

Figure 10A:
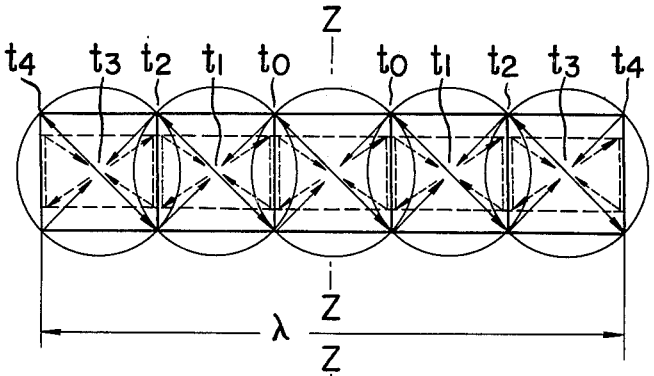
FIG. 10A is a vector diagram illustrating the conditions of FIG. 9B' where $n$ is taken as 5.
Figure 10B:
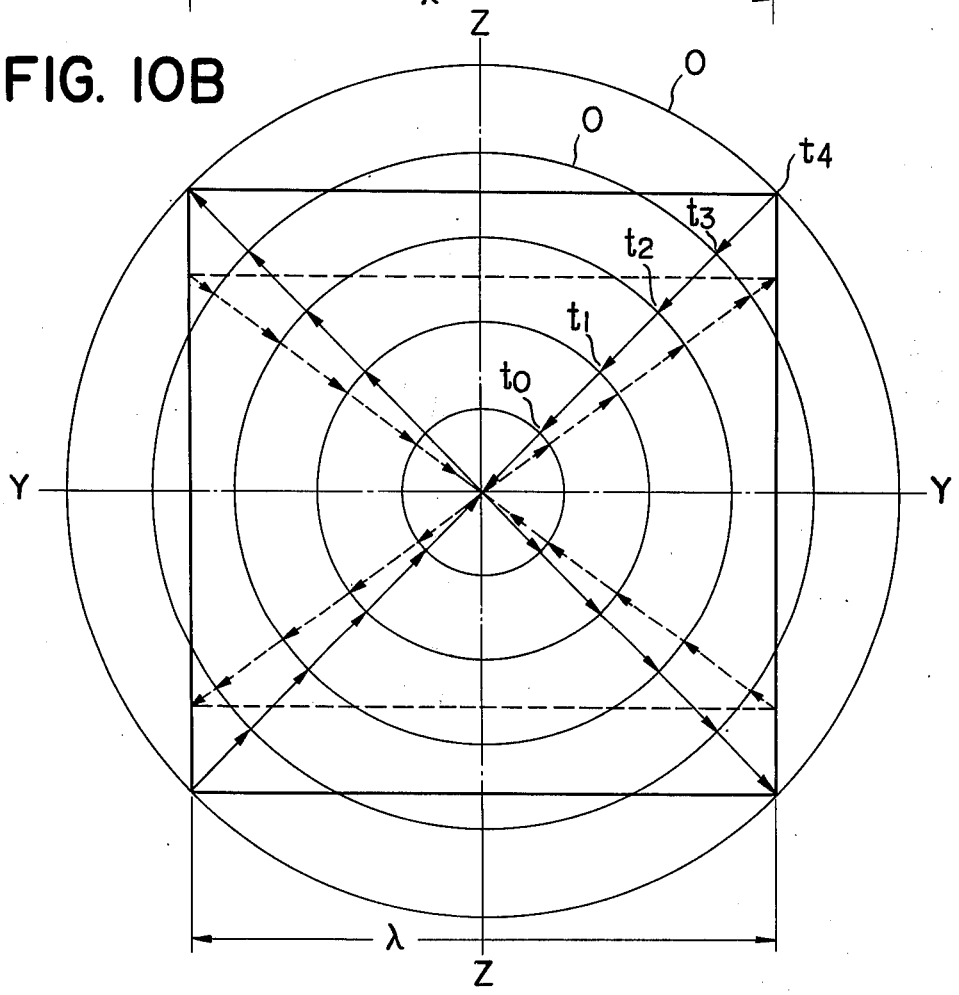
FIG. 10B is a vector diagram related to the specific example shown in FIG. 7, in which spheres having respective diameters of $\sqrt{2}/n\ \lambda$, $\sqrt{2}/n\ \sqrt{2}\ \lambda$, $3/n\ \sqrt{2}\ \lambda \ldots n/n\ \sqrt{2}\ \lambda$are disposed in concentric shell form in the case where $n$ is 5, and indicating that the total sum of the valve of each vector in each shell is equal to that of the vector of an antenna element having the length λ between two consecutive bends.

Formula VI contains the suggestion that an electric field expands isotropically with the passage of time, and that it is imaginable, if no consideration of time lag is assumed, that an oscillation occurring on the XYZ coordinate lines will make absolutely the same oscillation upon the X'Y'Z' coordinate lines, than it is seen that, with reference to FIG. 10A, time changes $t_0$, $t_1$, $t_3$, $t_4$ . . . are the same as if it is expanded spatially as shown in FIG. 10B.

Based upon the above-mentioned reasons, where the length of the respective sections of an antenna element each forming a longitudinal edge of a regular eight face polyhedron is taken as $\lambda/n$, it is seen that this antenna is the same as an antenna which has a section $\lambda$ in length, where $n$ antenna elements are connected in series with one another.

Generally speaking, with respect to an electromagnetic wave having a certain wave length, where the lengthof each of the sections of an antenns element 39 embodying the invention is taken as one quarter and one half of this wave length, the antenna element 39 resonates to an electromagnetic wave having a wave length equivalent to those resulting from a section length doubled by an integer. Also, an antenna element in accordance with the invention acts as a large antenna, that is, an antenna doubled by an integer $n$, if the number of infinitesimal antenna elements connected in series is brought close to infinity.

When the length of one side of a regular eight-face polyhedron antenna element is equivalent to one half the wavelength of an electromagnetic wave having a predetermined frequency, the antenna has the best capacity. For example, the wavelenth of an electromagnetic wave having a frequency of 90 MHZ is approximately 3.20 meters. Therefore, with an electromagnetic wave having a frequency of 90 MHZ, the antenna element vibrates most excellently when each edge or side of the eight-face polyhedron has a length equal to one half the wavelength, or 1.60 meters. Thus, an antenna element, in accordance with the present invention, and which has been formed as a regular eight-face polyhedron with longitudinal edges will have its best capacity when the length of each edge or side is 1.60 meters, where the electromagnetic wave oscillates at a frequency of 90 MHZ.

However, an an tenna element, formed by the longitudinal edges of the regular eight-face polyhedron, and with the length of the edges being 1.60 meters, is not suitable for the usual use because it will be subjected to too great a wind pressure and furthermore because it is difficult to find a location in which such an antenna element can be set up. Thus, in accordance with the present invention, by connecting 10 antenna elements in series with each other, each formed as a regular eight-faced polyhedron whose longitudinal edge has a length of 16 cm instead of 160 cm, the antenna will act substantially the same as an antenna element whose edge or side is as long as 160 cm or 1.60 meters. Similarly, by connecting in series 20 antenna elements, each in the form of a regular eight-face polyhedron and where the edge length is 8 cm, the resulting antenna has the same properties as an antenna element having an edge length of 160 cm or 1.60 meters. Stated in another way, a small volume antenna will have the same capacity as a large volume antenna element.

An antenna comprising a number of miniaturized antenna elements 39 connected in series with each other can be tuned to any frequency by selecting the number of miniaturized antenna elements in accordance with the various wavelengths. For the same reason, an antenna can be miniaturized in size by the use of antenna elements embodying the invention. This is true taking into consideration that is may be necessary to have the diameter of the metal bar or tubing, constituting the antenna element, extremely fine. However, in general, the diameter of the metal bar or tubing constituting the antenna element can be disregarded as long as the frequency band is near 100 MHZ.

In a trial manufacture of an antenna embodying the invention, there was constructed an antenna including five assemblies each consisting of four antenna elements embodying the invention. Each antenna element comprises sections having a length of 2 cm and corresponding to the longitudinal edges of a regular eight face polyhedron. All the antenna elements were connected in series with each other, and the five assemblies were set in a frame having a width of 15 cm, a height of 32 cm and a thickness of 3 cm. This antenna was set up in a room for use with a color television receiver, with the result that it produced a clear color picture. This was in spite of the fact that the location at which the picture was received was about 50 km distant from the transmitting station. Furthermore, the location was not too good with respect to the condition of the electric field for receiving the electric wave.

As set forth above, the invention provides a new antenna which is miniaturized in size to be far smaller in comparison with known dipole antennas or loop antennas, and which possesses induced electromotive forces greater than that of known antennas. Furthermore, the antenna has a specific directivity of up to four-directional directivities and, because the antenna element is capable of being connected in series with other identical antenna elements, an antenna is provided which can be tuned to any frequency. Furthermore, by setting up antenna assemblies in a frame and superposing a plurality of the frames one above the other, the antenna embodying the antenna elements of the invention can be manufactured to occupy only a small area. Because an antenna embodying the invention comprises an antenna element or elements which are miniaturized, it has the advantages of providing an antenna which is useful over a long period of time, resistant to wind pressure, and resistant to damage by corrosive atmospheres when the antenna is enclosed within the casing of non-electrically conductive, or dielectric, material such as wood, glass, or plastic.

In making a eight-face polyhedral antenna element embodying the invention, by mass production, there can be used conventional procedures for manufacturing printed circuits for radio or television. Thus, in making such an antenna element by the mentioned printing procedure, a plane figure of a regular eight-face polyhedral antenna element is printed on a silver plated layer with an oxidation resistant ink, and then the remainder of the layer, which has not been printed with oxidation resistant ink, is removed with an aqueous acidic solution leaving only the regular eight-face polyhedral antenna element, with the two bottom ends of the antenna element being formed as terminals.

While specific embodiments of the invention have been shown and described in detail to illustrate the application of the principles of the invention, it will be understood that the invention may be embodied otherwise without departing from such principles.

What is claimed is:

1. An antenna element comprising a single continuous length of electrically conductive metal bent into rectilinear sections to form longitudinal edge lines defining the faces of a regular eight-face polyhedron-shaped antenna element, with the two ends of the continuous length of electrically conductive metal being bent outwardly at the bottom of said polyhedron to form electrical terminals of the antenna element; the length of each rectilinear section, with respect to a preselected frequency of transmission and reception, being equal to one half the wave length of the radiation at such preselected frequency.

2. An antenna comprising a plurality of antenna elements, as claimed in claim 1, connected in series with each other, with the length of each rectilinear section of each antenna element being equal to one half the wave length of the radiation at a preselected frequency of transmission and reception, divided by the number of antenna elements connected in series with each other.

3. An antenna element, as claimed in claim 2, in which said plurality of antenna elements are mounted on a base plate of dielectric electrically non-conductive material.

4. An antenna assembly comprising a plurality of antennas, as claimed in claim 3, superposed on each other in a frame with all the antenna elements being connected in series with each other.

5. An antenna element, as claimed in claim 1, including a sealed casting of non-electrically conductive dielectric material enclosing said antenna element.

6. An antenna, as claimed in claim 4, enclosed in a sealed casing of non-electrically conductive dielectric material.

7. An antenna assembly, as claimed in claim 4, enclosed in a sealed casing of non-electrically conductive dielectric material.

* * * * *